US007814971B2

(12) United States Patent
Jones

(10) Patent No.: US 7,814,971 B2
(45) Date of Patent: Oct. 19, 2010

(54) DRILLING RIG AND VIBRATION DAMPENING SUPPORT FRAME

(76) Inventor: Jerry Jones, P.O. Box 215, Triton (CA) A0J 1V0

( * ) Notice: Subject to any disclaimer, the term of this patent is extended or adjusted under 35 U.S.C. 154(b) by 129 days.

(21) Appl. No.: 11/951,446

(22) Filed: Dec. 6, 2007

(65) Prior Publication Data

US 2008/0283300 A1 Nov. 20, 2008

(30) Foreign Application Priority Data

Dec. 6, 2006 (CA) ..... 2570225

(51) Int. Cl.
*E21B 19/00* (2006.01)
*E21B 19/08* (2006.01)

(52) U.S. Cl. ..... 166/75.11; 175/203; 248/638

(58) Field of Classification Search ..... 166/77.51, 166/75.11; 175/203, 162; 248/636, 638
See application file for complete search history.

(56) References Cited

U.S. PATENT DOCUMENTS 4,932,257 A * 6/1990 Webb ..... 73/40.5 R
5,524,716 A * 6/1996 Wachholz ..... 175/52
5,697,457 A * 12/1997 Back ..... 173/185

* cited by examiner

*Primary Examiner*—Jennifer H Gay
*Assistant Examiner*—Catherine Loikith
(74) *Attorney, Agent, or Firm*—Schmeiser, Olsen & Watts, LLP

(57) ABSTRACT

A drill rig includes a carrier platform and a drilling unit. The drilling unit includes a support frame mounted on the carrier platform, a slider frame mounted upon and surrounding the support frame, a drilling support mechanism mounted on the slider frame, a drill portion rotatable relative to drilling support mechanism, and a means for effecting rotation of the drill portion. The support frame assumes a substantially vertical position, and the slider frame is moved along the support frame to an operative position for effecting a drilling operation. The support frame comprises two main tower beams partially covered in High-Density Polyethylene plastic, and the slider frame comprises plates positioned on the top and bottom of the tower beams, with inside and outside joiner plates encasing the sides of the support frame. These plates being covered with HDPE plastic on the surface which contacts the support frame to substantially reduce vibration.

12 Claims, 4 Drawing Sheets

DRILLING RIG AND VIBRATION DAMPENING SUPPORT FRAME

CROSS-REFERENCE TO RELATED APPLICATION

This application claims priority to Canadian Patent Application No. 2,570,225 filed Dec. 6, 2006.

BACKGROUND OF THE INVENTION

1. Field of the Invention

This invention relates generally to drilling rigs and, more particularly, to drilling rigs having a vibration dampening support structure.

2. Related Art

Underground drilling, such as gas, oil, or geothermal drilling, generally involves drilling a bore through a formation deep in the earth. Such bores can be formed by connecting a drill bit to long sections of pipe, referred to as a "drill pipe," so as to form an assembly commonly referred to as a "drill string." The drill string extends from the surface to the bottom of the bore.

The drill bit is rotated so that the drill bit advances into the earth, thereby forming the bore. In rotary drilling, the drill bit is rotated by rotating the drill string at the surface. Piston-operated pumps on the surface pump high-pressure fluid, referred to as "drilling mud," through an internal passage in the drill string and out through the drill bit. The drilling mud lubricates the drill bit, and flushes cuttings from the path of the drill bit. The drilling mud then flows to the surface through an annular passage formed between the drill string and the surface of the bore.

The drilling environment, and especially hard rock drilling, can induce substantial vibration and shock into the drill string, and the drilling rig itself. Vibration also can be introduced by factors such as rotation of the drill bit, the motors used to rotate the drill string, pumping drilling mud, imbalance in the drill string, etc. Such vibration can result in premature failure of the various components of the drill string. Substantial vibration also can reduce the rate of penetration of the drill bit into the drilling surface, and in extreme cases can cause a loss of contact between the drill bit and the drilling surface.

Operators usually attempt to control drill string vibration by varying one or both of the following: the rotational speed of the drill string, and the down-hole force on the drill bit (commonly referred to as "weight-on-bit"). These actions often do not effectively reduce the vibrations. Reducing the weight-on-bit or the rotary speed of the drill bit usually reduces drilling efficiency. In particular, drill bits typically are designed for a predetermined rotary speed range and weight-on-bit. Operating the drill bit off of its design point can reduce the performance and the service life of the drill bit.

So-called "shock subs" are sometimes also used to dampen drilling vibrations. Shock subs, however, typically are optimized for one particular set of drilling conditions. Operating the shock sub outside of these conditions can render the shock sub ineffective, and in some cases can actually increase drill string vibrations. Moreover, shock subs and isolators usually isolate the portions of the drill string up-hole of the shock sub or isolator from vibration, but can increase vibration in the down-hole portion of the drill string, including the drill bit.

Thus, there is a need for an improved drilling rig and drilling system that can dampen drilling and drill-string vibrations, throughout a range of operating conditions. In this regard, the present invention substantially fulfills this need.

SUMMARY OF THE INVENTION

The object of the present invention is to provide an improved drilling rig and support frame which substantially reduces vibration problems associated with drilling operations.

Another object of the present invention is to provide an improved drilling rig and support frame which substantially reduces vibration problems associated with drilling operations by placing vibration dampening material, such as HDPE plastic, around outside surfaces of the support frame, and on any surfaces of the slider frame mounted thereon which contact the outside surfaces of the support frame.

According to one aspect of the present invention, there is provided a drill rig comprising a carrier platform; a support frame pivotally mounted on the carrier platform, outside surfaces of the support frame being covered with vibration dampening material; a slider frame slidably mounted upon and surrounding the support frame, wherein surfaces of the slider frame which contact the support frame are covered with vibration dampening material; a drilling support mechanism mounted on the slider frame; a drill portion mounted on the drilling support mechanism and rotatable relative to the drilling support mechanism; and power means for effecting rotation of the drill portion.

According to another aspect of the present invention, there is provided a vibration reducing system for a drill rig comprising providing a carrier platform; providing a support frame pivotally mounted on the carrier platform; covering outside surfaces of the support frame with vibration dampening material; slidably mounting a slider frame upon and substantially around a width of the support frame; covering surfaces of the slider frame which contact the support frame with vibration dampening material; mounting a drilling support mechanism mounted on the slider frame; mounting a drill portion on the drilling support mechanism, the drill portion being rotatable relative to the drilling support mechanism; and providing power means for effecting rotation of the drill portion, wherein, when a drilling operation is to be effected, the support frame is pivotally moved to assume a substantially vertical position relative to the carrier platform, and when the support frame has assumed the substantially vertical position, the slider frame is slidably moved along the support frame to an operative position for effecting a drilling operation by the drill portion.

According to still another aspect of the present invention, there is provided a drilling feed frame assembly for a drilling rig, comprising a support frame pivotally mounted on a carrier platform, outside surfaces of the support frame being covered with vibration dampening material; a slider frame slidably mounted upon and surrounding the support frame, outside surfaces of the slider frame which contact the support frame being covered with vibration dampening material; a drilling support mechanism mounted on the slider frame; a drill portion mounted on the drilling support mechanism and rotatable relative to the drilling support mechanism; and power means for effecting rotation of the drill portion.

As previously discussed, the advantage of the present invention is that it provides an improved drilling rig and support frame which substantially reduces vibration problems associated with drilling operations.

A further advantage of the present invention is that it easily provides an improved drilling rig and support frame which substantially reduces vibration problems associated with drilling operations by placing vibration dampening material, such as HDPE plastic, around outside surfaces of the support frame, and on any surfaces of the slider frame mounted thereon which contact the outside surfaces of the support frame.

These and other objects and embodiments of the inventive disclosures made herein will become readily apparent upon further review of the following specification and associated drawings.

BRIEF DESCRIPTION OF THE DRAWINGS

A preferred embodiment of the present invention is described below with reference to the accompanying drawings, in which.

DETAILED DESCRIPTION OF THE DRAWINGS

Figure 1:
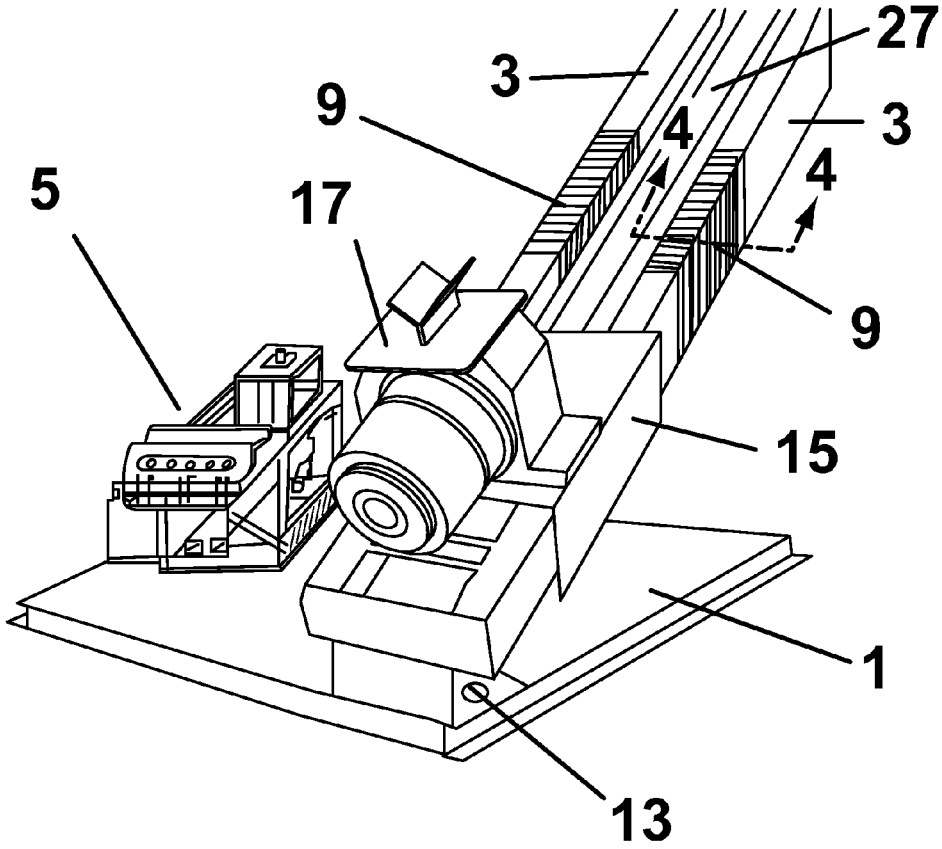
FIG. 1 is a front view of one embodiment of the drilling rig and vibration dampening support structure of the present invention, the structure being shown in the substantially vertical operating position.
Figure 2:
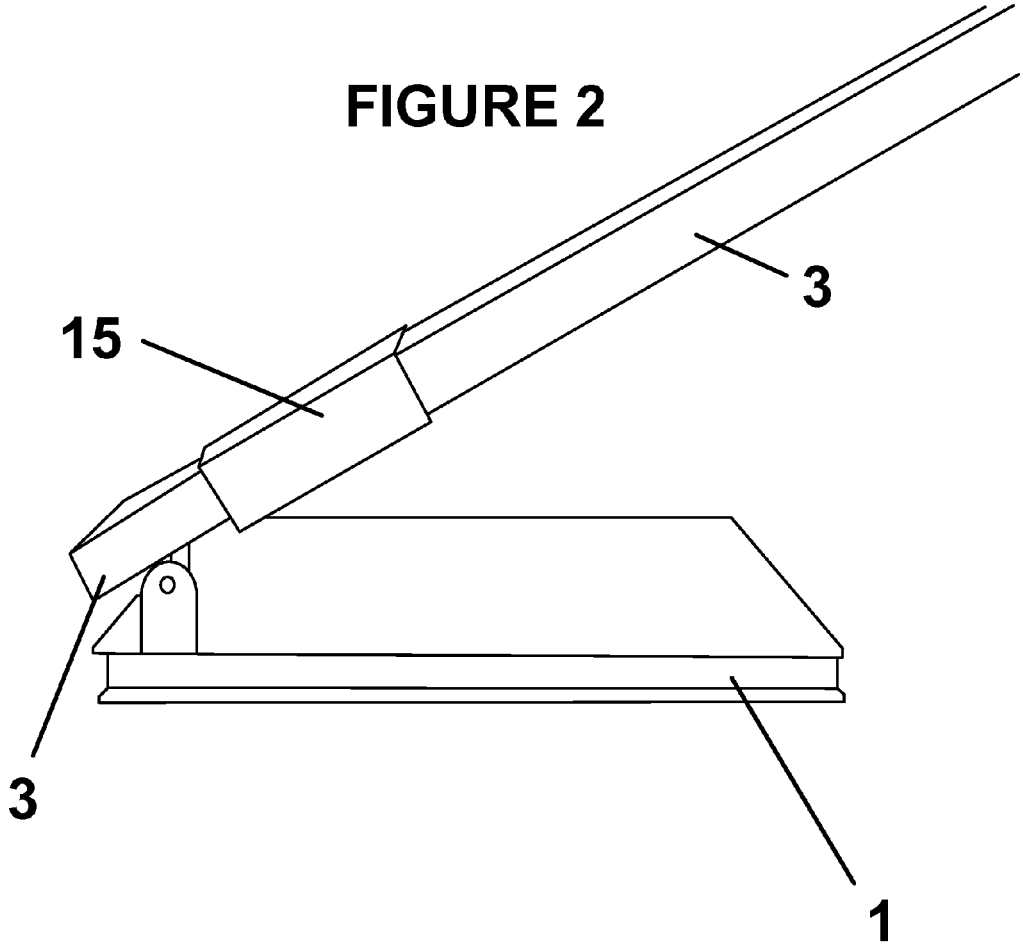
FIG. 2 is a side view of the embodiment of the drilling rig and vibration dampening support structure shown in FIG. 1.
Figure 3:
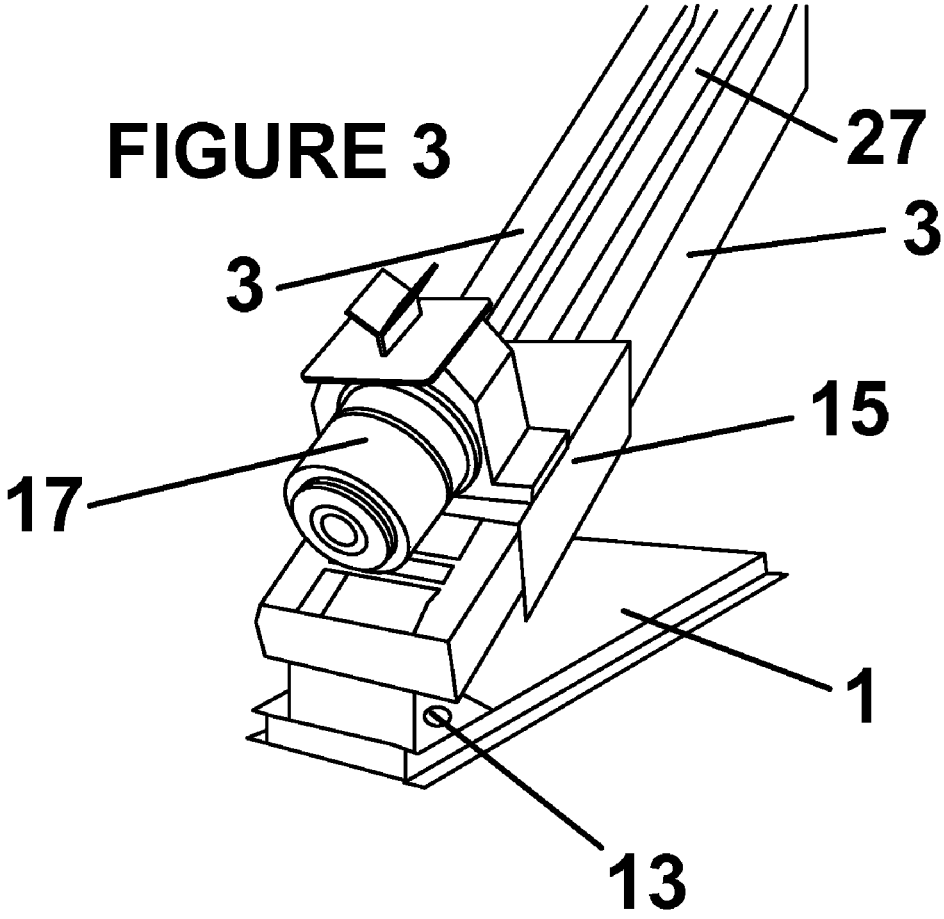
FIG. 3 is a perspective view of the embodiment of the drilling rig and vibration dampening support structure shown in FIG. 1.

FIGS. 1 to 3 depict an embodiment of the drilling rig and vibration dampening support structure of the present invention. With reference to FIGS. 1 and 3, the drill rig of the present invention includes a carrier platform 1 and a drilling unit carried by the carrier platform. The drilling unit includes a support frame 3 pivotally mounted 13 on the carrier platform, as seen in FIG. 2. A slider frame 15 is slidably mounted upon and surrounding the support frame 3, and, with reference to FIG. 3, a drilling support mechanism 17 is mounted on the slider frame 15. A drill portion 27 is also provided on the drilling support mechanism, the drill portion 27 being rotatable relative to said drilling support mechanism, and a power means 5 can also be provided through use of a control panel, with reference to FIG. 1, for effecting rotation of the drill portion 27. In a preferred embodiment, the slider frame 15 is mounted upon and substantially around a width of the support frame 3, as can be seen with reference to FIG. 3.

When a drilling operation is to be effected, the support frame 3 is pivotally moved to assume a substantially vertical position, as can be seen in FIG. 1, and the slider frame 15 is slidably moved along the support frame 3 to an operative position for effecting a drilling operation. In some embodiments, the support frame 3 comprises two main tower beams partially covered in a vibration dampening material, such as High-Density Polyethylene (HDPE) plastic 9, though it will be obvious to persons skilled in the art that a number of vibration reducing materials could also be utilized, such as silicone rubber, visco-elastic polymers, or damping sheets manufactured from a Bitumen or PVA based material.

In a preferred embodiment, the tower beams are 6"×6" and are made of aluminum, though it will be apparent that modifications to this could be effected, as would be apparent to one skilled in the art.

Figure 4:
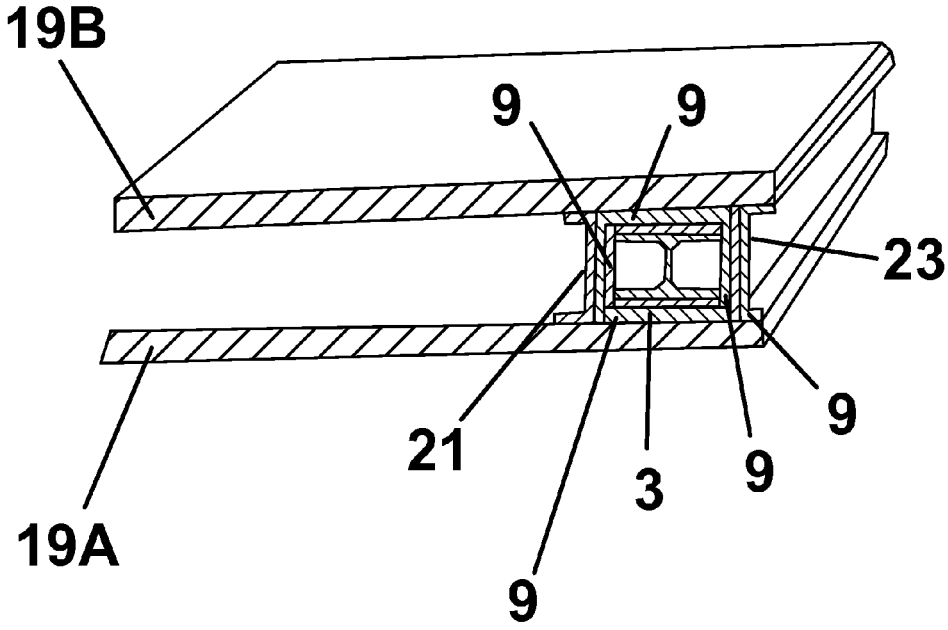
FIG. 4 is a perspective view of one embodiment of the slider frame encasing the support frame.

With reference to FIG. 4, the slider frame 15 which surrounds the support frame 3 comprises plates 19A and 19B, preferably made of aluminum, and are positioned on the top and bottom of the tower beams, with inside 21 and outside 23 joiner plates encasing the sides of the support frame 3. Each of these plates are covered with HDPE plastic 9 on the surface which contacts the support frame 3. The plates, beams and outside and inside joiner plates bolt together, in a preferred embodiment, to form two "boxes" that substantially enclose a width of the tower beams of the support frame 3, as can be seen with reference to FIG. 3. In this manner, vibration from the drilling operation is substantially reduced.

The present invention has been described herein with regard to preferred embodiments. However, it will be obvious to persons skilled in the art that a number of variations and modifications can be made without departing from the scope of the invention as described herein. There are numerous variations and modifications thereof that will also remain readily apparent to others skilled in the art, now that the general principles of the present invention have been disclosed.

What is claimed is:

1. A drill rig comprising:

a carrier platform;

a support frame pivotally mounted on the carrier platform, outside surfaces of the support frame being covered with a first layer of vibration dampening material;

a slider frame slidably mounted upon and surrounding the support frame, wherein the slider frame further comprises a top plate and a bottom plate for covering top and bottom surfaces of the support frame, and outside and inside joiner plates for respectively covering side surfaces of the support frame, and wherein surfaces of the plates which contact an outside surface of the support frame are also covered with a second layer of vibration dampening material, the first layer and the second layer of the vibration dampening material contacting each other along at least a partial length of the support frame;

a drilling support mechanism mounted on the slider frame;

a drill portion mounted on the drilling support mechanism and rotatable relative to the drilling support mechanism; and power means for effecting rotation of the drill portion.

2. The drill rig of claim 1, wherein, when a drilling operation is to be effected, the support frame is pivotally moved to assume a substantially vertical position relative to the carrier platform.

3. The drill rig of claim 2, wherein, when the support frame is pivotally moved to assume the substantially vertical position relative to the carrier platform, the slider frame is slidably moved along the support frame to an operative position for effecting a drilling operation by the drill portion.

4. The drill rig of claim 3, wherein the vibration dampening material is HDPE plastic.

5. The drill rig of claim 4, wherein the support frame comprises a pair of spaced apart beams.

6. The drill rig of claim 1, wherein the slider frame is mounted upon and substantially around a width of the support frame.

7. A vibration reducing system for a drill rig comprising:

providing a carrier platform;

providing a support frame pivotally mounted on the carrier platform;

covering outside surfaces of the support frame with a first layer of vibration dampening material;

slidably mounting a slider frame upon and substantially around a width of the support frame, wherein the slider frame further comprises a top plate and a bottom plate for covering top and bottom surfaces of the support frame, and outside and inside joiner plates for respectively covering side surfaces of the support frame;

covering surfaces of the plates which contact the support frame with a second layer of vibration dampening material, the first layer and the second layer of the vibration dampening material contacting each other along at least a partial length of the support frame;

mounting a drilling support mechanism mounted on the slider frame;

mounting a drill portion on the drilling support mechanism, the drill portion being rotatable relative to the drilling support mechanism; and providing power means for effecting rotation of the drill portion, wherein, when a drilling operation is to be effected, the support frame is pivotally moved to assume a substantially vertical position relative to the carrier platform, and when the support frame has assumed the substantially vertical position, the slider frame is slidably moved along the support frame to an operative position for effecting a drilling operation by the drill portion.

8. The system of claim 7, wherein the vibration dampening material is HDPE plastic.

9. The system of claim 7, wherein the support frame comprises a pair of spaced apart beams.

10. A drilling feed frame assembly for a drilling rig, comprising:

a support frame pivotally mounted on a carrier platform, outside surfaces of the support frame being covered with a first layer of vibration dampening material;

a slider frame slidably mounted upon and surrounding the support frame, wherein the slider frame further comprises a top plate and a bottom plate for covering top and bottom surfaces of the support frame, and outside and inside joiner plates for respectively covering side surfaces of the support frame, and wherein surfaces of the plates which contact an outside surface of the support frame are also covered with a second layer of vibration dampening material, the first layer and the second layer of the vibration dampening material contacting each other along at least a partial length of the support frame;

a drilling support mechanism mounted on the slider frame;

a drill portion mounted on the drilling support mechanism and rotatable relative to the drilling support mechanism; and power means for effecting rotation of the drill portion.

11. The drilling feed frame assembly of claim 10, wherein the vibration dampening material is HDPE plastic.

12. The drilling feed frame assembly of claim 10, wherein the support frame comprises a pair of spaced apart beams.

* * * * *